US011821638B2

(12) United States Patent
Watanabe et al.

(10) Patent No.: US 11,821,638 B2
(45) Date of Patent: Nov. 21, 2023

(54) COMPRESSOR UNIT, OUTDOOR UNIT OF AIR-CONDITIONING APPARATUS, AND AIR-CONDITIONING APPARATUS

(71) Applicant: Mitsubishi Electric Corporation, Tokyo (JP)

(72) Inventors: Masayuki Watanabe, Tokyo (JP); Hiroyuki Jinnai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 636 days.

(21) Appl. No.: 17/043,750

(22) PCT Filed: May 25, 2018

(86) PCT No.: PCT/JP2018/020169
§ 371 (c)(1),
(2) Date: Sep. 30, 2020

(87) PCT Pub. No.: WO2019/225006
PCT Pub. Date: Nov. 28, 2019

(65) Prior Publication Data

US 2021/0033290 A1 Feb. 4, 2021

(51) Int. Cl.
*F24F 1/12* (2011.01)
*F24F 13/24* (2006.01)

(52) U.S. Cl.
CPC ..... *F24F 1/12* (2013.01); *F24F 13/24* (2013.01); *F24F 2013/242* (2013.01)

(58) Field of Classification Search
CPC ..... F24F 1/12; F24F 13/24; F24F 2013/242; F24F 1/40; F25B 2500/13; F25B 2500/12; F04B 39/0027
See application file for complete search history.

(56) References Cited

U.S. PATENT DOCUMENTS 6,062,033 A * 5/2000 Choi ..... F04B 39/0033 62/296

FOREIGN PATENT DOCUMENTS

JP H06-257796 A 9/1994
JP H09-287782 A 4/1997
JP 3300719 B2 * 7/2002 ..... F04B 39/00

OTHER PUBLICATIONS

English language translation of JP3300719B2 to Hironari et al. Entire document. Translated Jun. 2023 (Year: 2002).*

(Continued)

*Primary Examiner* — Cassey D Bauer
(74) *Attorney, Agent, or Firm* — POSZ LAW GROUP, PLC

(57) ABSTRACT

A compressor unit includes a compressor, pipes connected to a suction side and a discharge side of the compressor, and a sound absorbing member. The sound absorbing member includes a plurality of support portions, where at least one of the plurality of support portions is a hook portion formed by folding the sound absorbing member and joining upper edge portions of the sound absorbing member to each other. The pipes include a bent portion that connects two portions extending in an up/down direction and that is located in an upper region in the compressor unit. An upper portion of the sound absorbing member is positioned by hooking the hook portion to one of the bent portions, and the sound absorbing member is held by the plurality of support portions such that the sound absorbing member is suspended and thus located apart from a base on which the compressor is mounted.

17 Claims, 11 Drawing Sheets

(56) References Cited

OTHER PUBLICATIONS

International Search Report of the International Searching Authority dated Aug. 21, 2018 for the corresponding International application No. PCT/JP2018/020169 (and English translation).

* cited by examiner

COMPRESSOR UNIT, OUTDOOR UNIT OF AIR-CONDITIONING APPARATUS, AND AIR-CONDITIONING APPARATUS

CROSS REFERENCE TO RELATED APPLICATION

This application is a U.S. national stage application of PCT/JP2018/020169 filed on May 25, 2018, the contents of which are incorporated herein by reference.

TECHNICAL FIELD

The present disclosure relates to a compressor unit including a sound absorbing member, to an outdoor unit of an air-conditioning apparatus, and to an air-conditioning apparatus.

BACKGROUND ART

In general, in outdoor units of air-conditioning apparatuses, a compressor is surrounded by a sound absorbing member in order to reduce sound emitted from the compressor.

When the compressor is operated, condensation dew forms on a suction muffler or a suction pipe, and water drops and collects on a base of the outdoor unit. The sound absorbing member, which covers the body of the compressor, absorbs the water. When being in contact with the sound absorbing member absorbing the water for a long time period, the compressor is corroded. Therefore, the sound absorbing member is required not to absorb water.

Patent Literature 1 proposes a sound absorbing member that is provided to cover a compressor such that the sound absorbing member is located apart from a base of an outdoor unit, and that is directly wrapped about the compressor, which is a noise source, to thereby improve a sound absorption performance.

CITATION LIST

Patent Literature

Patent Literature 1: Japanese Unexamined Patent Application Publication No. Hei 9-287782

SUMMARY OF INVENTION

Technical Problem

However, in the technique disclosed in Patent Literature 1, the working efficacy of a work of wrapping the sound absorbing member about the compressor is reduced because of provision of pipes provided close to the compressor. It is therefore necessary to attach the sound absorbing member before the compressor and the pipes are welded to each other. Furthermore, the sound absorbing member needs to be appropriately designed and shaped not to touch a flame given at the time of welding the compressor and the pipes to each other after the sound absorbing member is wrapped about the compressor. Alternatively, it is necessary to use a high flameproof material for the sound absorbing member.

The present disclosure is applied to solve the above problem, and relates to a compressor unit that includes a compressor and pipes and has a side surface portion whose outer periphery is substantially entirely surrounded by a sound absorbing member, and that can be efficiently assembled, whereby the working efficiency can be improved, and also to an outdoor unit of an air-conditioning apparatus, and an air-conditioning apparatus.

Solution to Problem

A compressor unit according to an embodiment of the present disclosure includes a compressor, pipes connected to a suction side and a discharge side of the compressor, and a sound absorbing member formed to surround an outer periphery of a side surface portion of the compressor unit. The sound absorbing member includes a plurality of support portions that are supported at at least two positions of the compressor unit. At least one of the plurality of support portions is a hook portion that is formed by folding the sound absorbing member and joining upper edge portions of the sound absorbing member to each other. The pipes include a bent portion that connects two portions extending in an up/down direction and that is located in an upper region in the compressor unit. An upper portion of the sound absorbing member is positioned by hooking the hook portion to one of the bent portions, and the sound absorbing member is held by the plurality of support portions such that the sound absorbing member is suspended and thus located apart from a base on which the compressor is mounted.

An outdoor unit for an air-conditioning apparatus, according to the embodiment of the present disclosure, includes the above compressor unit.

An air-conditioning apparatus according to the embodiment of the present disclosure includes the above outdoor unit for the air-conditioning apparatus.

ADVANTAGEOUS EFFECTS OF INVENTION

According to the compressor unit, the outdoor unit of the air-conditioning apparatus, and the air-conditioning apparatus according to the embodiment of the present disclosure, the upper portion of the sound absorbing member is positioned by hooking the hook portion to the bent portion, and the sound absorbing member is held by the plurality of support portions such that the sound absorbing member is suspended, and thus located apart from the base on which the compressor is mounted. Therefore, for example, after the compressor and the pipes are welded to each other, the sound absorbing member can be attached to the entire compressor unit. Thus, the sound absorbing member can surround the substantially entire periphery of the side surface portion of the unit including the compressor and the pipes, whereby the compressor unit can be efficiently assembled and the working efficiency can be improved.

DESCRIPTION OF EMBODIMENT

An embodiment of the present disclosure will be described with reference to the above figures. In each of the figures, components that are the same as those in a previous figure are denoted by the same reference signs. The same is true of the entire text of the specification. In sectional views, hatching is omitted as appropriate in view of visibility. Furthermore, configurations of components that are described in the entire specification are merely examples, that is, the configurations of the components are not limited to those described in the specification.

Embodiment 1

<Configuration of Air-Conditioning Apparatus 100>

Figure 1:
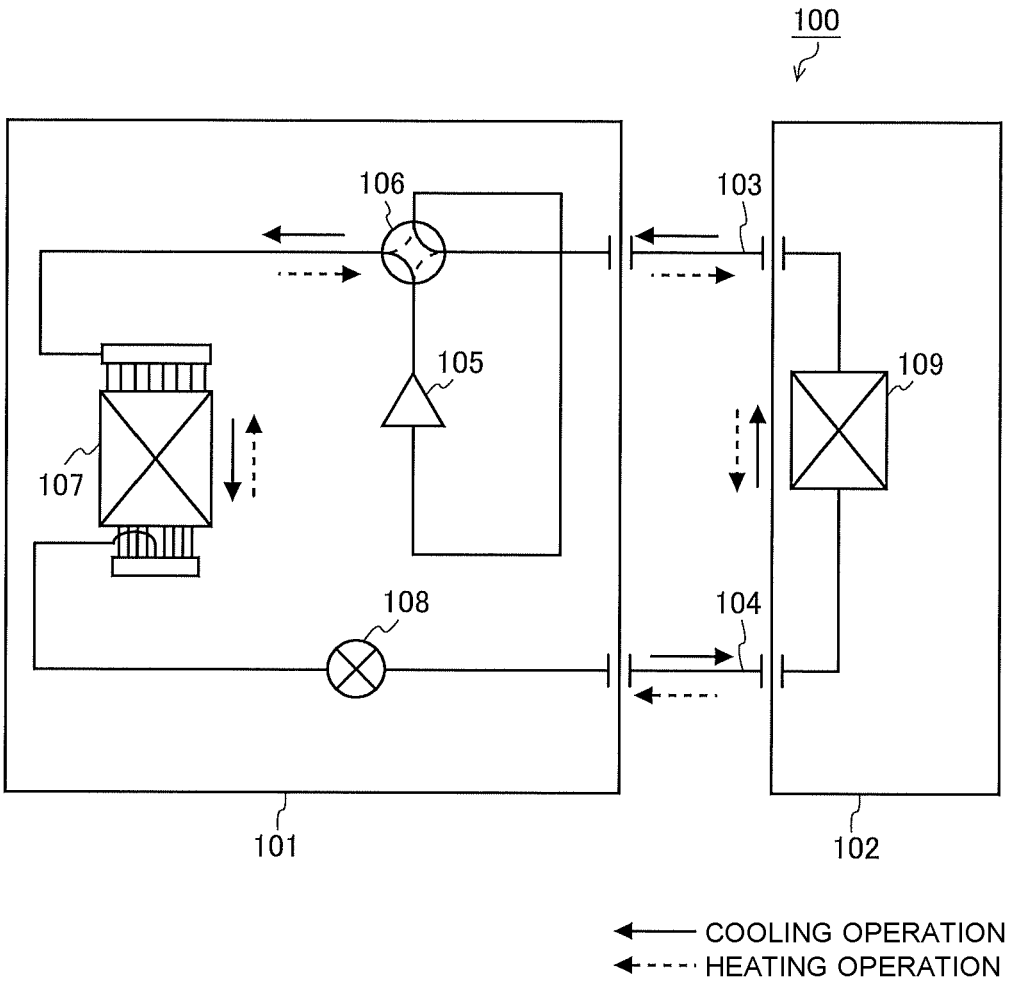
FIG. 1 is a refrigerant circuit diagram illustrating an air-conditioning apparatus according to an embodiment 1 of the present disclosure.

FIG. 1 is a refrigerant circuit diagram illustrating an air-conditioning apparatus 100 according to an embodiment 1 of the present disclosure. In the air-conditioning apparatus 100 as illustrated in FIG. 1, an outdoor unit 101 and an indoor unit 102 are connected to each other by a gas refrigerant pipe 103 and a liquid refrigerant pipe 104.

The outdoor unit 101 includes a compressor 105, a four-way valve 106, an outdoor heat exchanger 107, and an expansion valve 108.

The compressor 105 compresses sucked refrigerant, and discharges the refrigerant. The compressor 105 may be configured such that an operation frequency of the compressor 105 is arbitrarily changed by, for example, an inverter circuit or other components to change the rate at which refrigerant is discharged by the compressor 105 per unit time.

The four-way valve 106 is a valve that switches the flow of refrigerant between the flow of refrigerant for a cooling operation and that for a heating operation, for example.

The outdoor heat exchanger 107 causes heat exchange to be performed between refrigerant and outdoor air. The outdoor heat exchanger 107 operates as a condenser during the cooling operation to condense and liquefy refrigerant. The outdoor heat exchanger 107 operates as an evaporator during the heating operation to evaporate and vaporize refrigerant.

The expansion valve 108 is a flow control valve, and reduces the pressure of refrigerant to expand the refrigerant. In the case where the expansion valve 108 is an electronic expansion valve or other components, for example, an opening degree of the expansion valve 108 can be adjusted in response to an instruction from a controller not illustrated.

The indoor unit 102 includes an indoor heat exchanger 109. The indoor heat exchanger 109 causes heat exchange to be performed between air to be conditioned and refrigerant, for example. The indoor heat exchanger 109 operates as an evaporator during the cooling operation to evaporate and vaporize refrigerant. The indoor heat exchanger 109 operates as a condenser during the heating operation to condense and liquefy refrigerant.

Since the air-conditioning apparatus 100 is configured as described above, the flow of refrigerant can be switched by the four-way valve 106 of the outdoor unit 101, whereby the cooling operation or the heating operation can be performed.

<Configuration of Outdoor Unit 101 of Air-Conditioning Apparatus 100>

Figure 2:
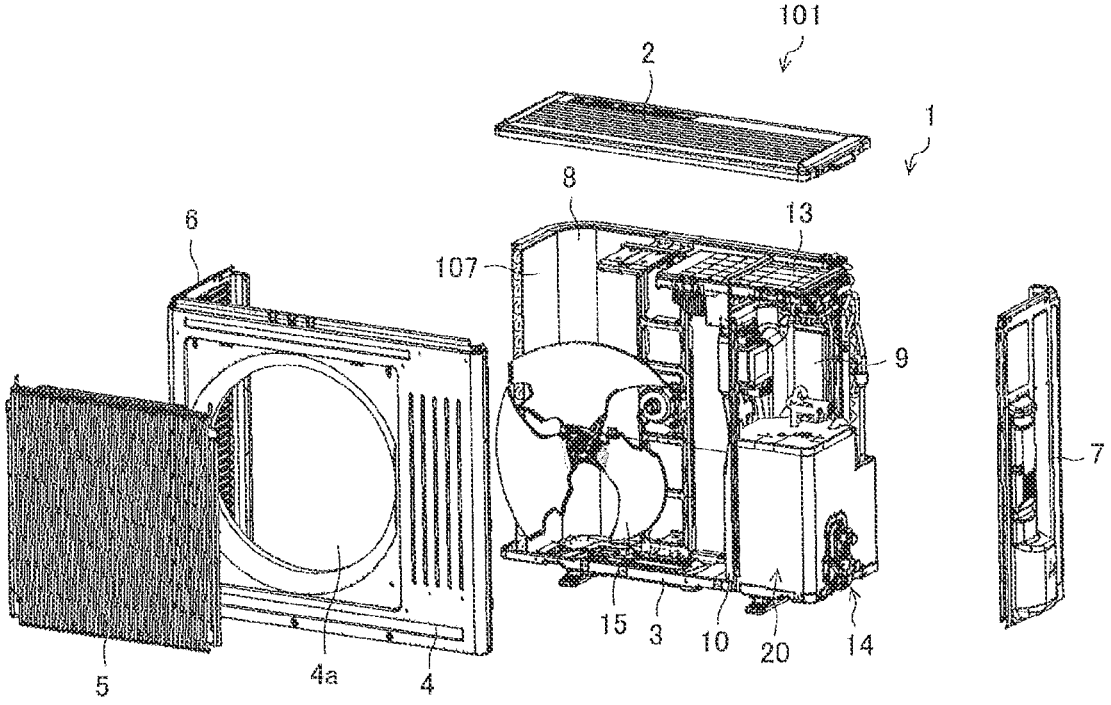
FIG. 2 is an exploded perspective view illustrating an outdoor unit of the air-conditioning apparatus according to the embodiment 1 of the present disclosure.
Figure 3:
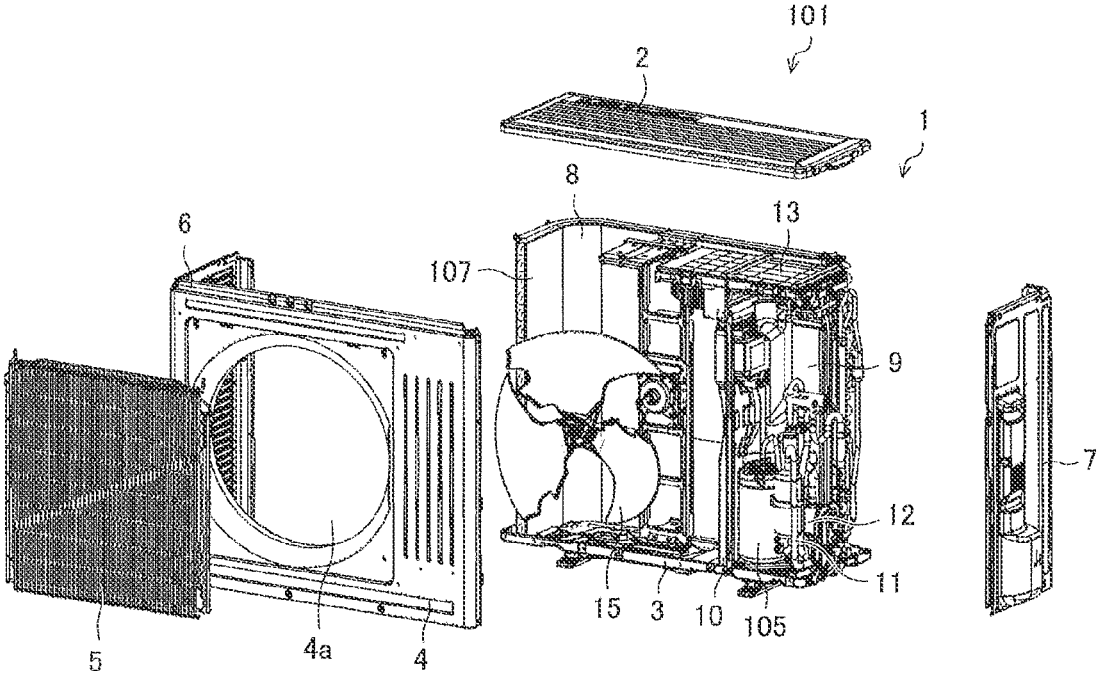
FIG. 3 is an exploded perspective view illustrating the outdoor unit of the air-conditioning apparatus according to the embodiment 1 of the present disclosure, with a soundproof structure of a compressor unit removed from the outdoor unit.

FIG. 2 is an exploded perspective view illustrating the outdoor unit 101 of the air-conditioning apparatus 100 according to the embodiment 1 of the present disclosure. FIG. 3 is an exploded perspective view illustrating the outdoor unit 101 of the air-conditioning apparatus 100 according to the embodiment 1 of the present disclosure, with a soundproof structure 20 of a compressor unit 14 removed from the outdoor unit 101.

<Housing of Outdoor Unit>

As illustrated in FIGS. 2 and 3, the outdoor unit 101 includes a cuboid housing 1 that houses various components. The housing 1 of the outdoor unit 101 has a top panel 2 at an upper portion of the housing 1 as viewed from the front. The housing 1 has a base 3 on a bottom side of the housing 1. The housing 1 has a front panel 4 on a front side of the housing 1. The front panel 4 has a circular opening portion 4*a* through which air is sucked by a fan 15. A lattice-shaped fan guard 5 is attached to an outer periphery of a front portion of the opening portion 4*a*. The housing 1 has a left side panel 6 on the left side of the housing 1 as viewed from the front, the left side panel 6 extending from an end portion of the front panel 4 along the left side of the housing 1. The housing 1 has a right side panel 7 on the right side of the housing 1 as viewed from the front.

<Internal Configuration of Outdoor Unit 101>

As illustrated in FIGS. 2 and 3, the outdoor unit 101 includes an air-sending device chamber 8 on the left side of the outdoor unit 101 as viewed from the front. The outdoor unit 101 includes a machine chamber 9 on the right side of the outdoor unit 101 as viewed from the front. The air-sending device chamber 8 and the machine chamber 9 are isolated from each other by a separator 10.

As illustrated in FIG. 3, the compressor 105, pipes 11, a suction muffler 12, an electric component box 13, and other components are provided in the machine chamber 9. Refrigerant that flows into the machine chamber 9 through the gas refrigerant pipe 103 or the liquid refrigerant pipe 104 is sent to the compressor 105 through a pipe 11 via the suction muffler 12. The refrigerant is compressed by the compressor 105, passes through a pipe 11 located on a discharge side of the compressor 105, and is sent to either the outdoor heat exchanger 107 or the indoor heat exchanger 109. Furthermore, the electric component box 13 supplies electric power to each of components.

As illustrated in FIG. 2, the compressor 105, the pipes 11, and the suction muffler 12 form the compressor unit 14 covered by the soundproof structure 20. The soundproof structure 20 will be described later in detail.

As illustrated in FIGS. 2 and 3, the outdoor heat exchanger 107, the fan 15, a fan motor not illustrated, a motor support not illustrated, and other components are provided in the air-sending device chamber 8. The outdoor heat exchanger 107 is L-shaped as viewed from above, and is provided in a rear region of the air-sending device chamber 8 that is located behind the fan 15. To be more specific, the outdoor heat exchanger 107 is provided in a rear and left region of the housing 1 as viewed from the front. The fan motor drives and rotates the fan 15. The motor support fixes the fan motor.

<Brief Description of Compressor Unit 14>

Figure 4:
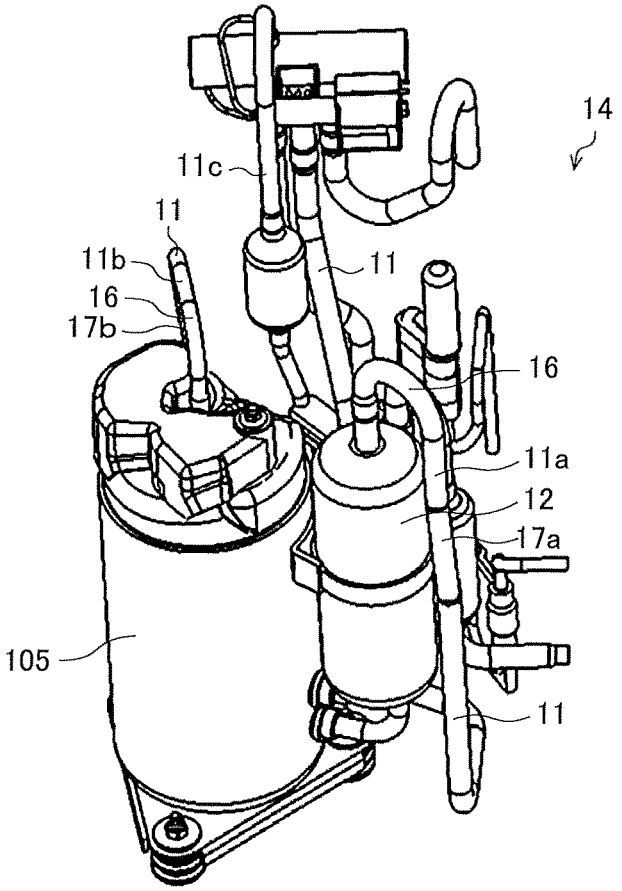
FIG. 4 is a perspective view illustrating the compressor unit according to the embodiment 1 of the present disclosure.

FIG. 4 is a perspective view illustrating the compressor unit 14 according to the embodiment 1 of the present disclosure. As illustrated in FIG. 4, the compressor unit 14 provided in the outdoor unit 101 includes the compressor 105, the pipes 11, and the suction muffler 12. The compressor unit 14 is surrounded by the soundproof structure 20 after being installed.

<Pipes 11 of Compressor Unit 14>

The pipes 11 includes a pipe 11*a*, a pipe 11*b*, and a pipe 11*c*. The pipe 11*a* is connected to a suction side of the compressor 105. The pipe 11*b* is connected to the discharge side of the compressor 105. The pipe 11*c* is connected to the indoor heat exchanger 109 or the outdoor heat exchanger 107.

<Pipe 11*a* Connected to Suction Side of Compressor 105>

The pipe 11*a* is connected to the suction side of the compressor 105. The pipe 11*a* is connected to an outer peripheral surface of a lower portion of the compressor 105, extends upwards, and is connected to the suction muffler 12 at an intermediate portion of the pipe 11*a*. The pipe 11*a* connected to the suction side of the compressor 105 includes a bent portion 16. The bent portion 16 connects part of the pipe 11*a* that is connected to the suction muffler 12 and extends in an up/down direction and part of the pipe 11*a* that extends in the up/down direction at a location adjacent to the former part. The bent portion 16 is located at a higher position than an upper surface of the compressor 105 that is located in an upper region in the compressor unit 14. The bent portion 16 is inverted U-shaped part of the pipe 11*a*. Part of the pipe 11 at which the suction muffler 12 is provided and part of the pipe 11 which extends downwards from the bent portion 16 correspond to an upward/downward extending portion 17*a* that is located adjacent to the compressor 105 and extends in the up/down direction.

<Pipe 11*b* Connected to Discharge Side of Compressor 105>

The pipe 11*b* is connected to the discharge side of the compressor 105. The pipe 11*b* includes a bent portion 16. The bent portion 16 connects part of the pipe 11*b* that is connected to the upper surface of the compressor 105 and that extends in the up/down direction and part of the pipe 11*b* that is located adjacent to the former part and extends in the up/down direction. The bent portion 16 is located at a higher position than the upper surface of the compressor 105 that is located in the upper region in the compressor unit 14. The bent portion 16 is inverted U-shaped part of the pipe 11*b*. Part of the pipe 11 that extends downwards from the bent portion 16 is an upward/downward extending portion 17*b* that is located adjacent to the compressor 105 and extends in the up/down direction.

<Soundproof Structure 20 of Compressor Unit 14>

Figure 5:
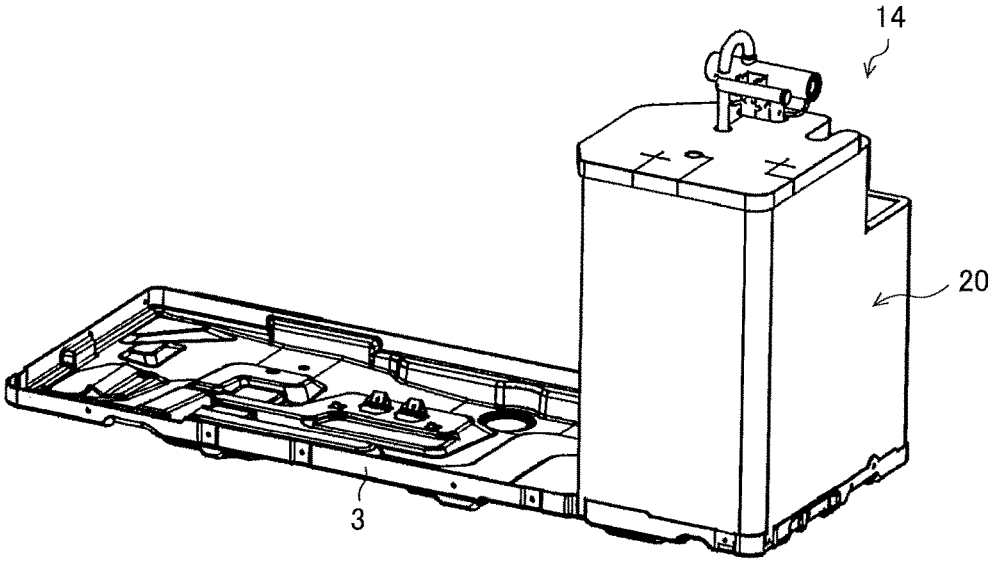
FIG. 5 is a perspective view illustrating the compressor unit according to the embodiment 1 of the present disclosure that is mounted on a base and that includes the soundproof structure.
Figure 6:
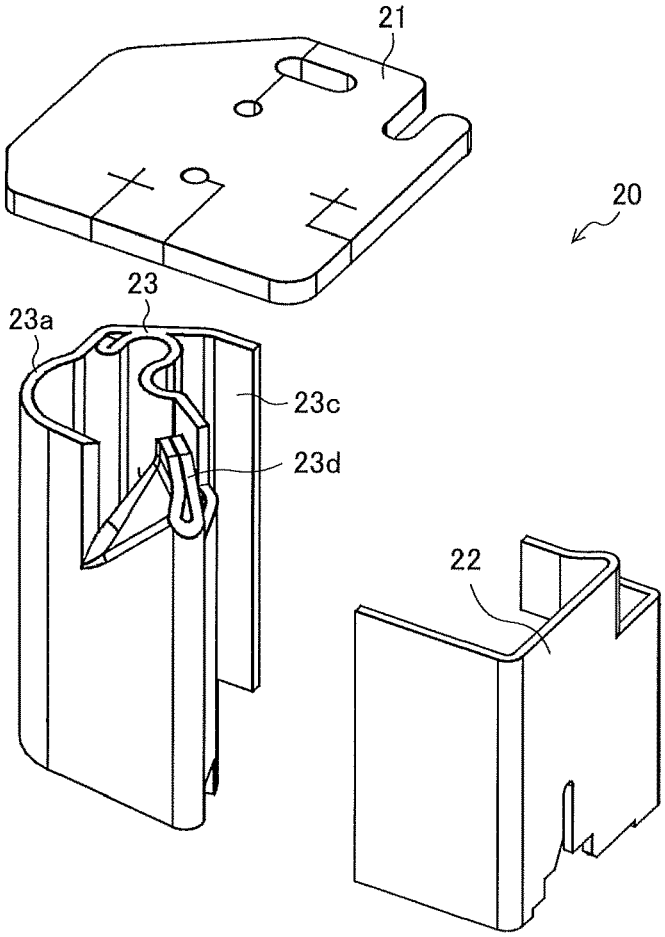
FIG. 6 is an exploded perspective view illustrating the soundproof structure according to the embodiment 1 of the present disclosure.

FIG. 5 is a perspective view illustrating the compressor unit 14 according to the embodiment 1 of the present disclosure that is mounted on the base 3 and that includes the soundproof structure 20. FIG. 6 is an exploded perspective view illustrating the soundproof structure 20 according to the embodiment 1 of the present disclosure.

As illustrated in FIG. 5, the compressor unit 14 is provided on the base 3 and surrounded by the soundproof structure 20. The soundproof structure 20 is provided to insulate the compressor unit 14 against noise made by the compressor 105. As illustrated in FIG. 6, the soundproof structure 20 includes a top cover 21, a side cover 22, and a sound absorbing member 23.

The sound absorbing member 23 is located inward of the side cover 22 and surrounds the compressor unit 14. The side cover 22 is set on an outer peripheral portion of the sound absorbing member 23 to cover the outer peripheral portion of the sound absorbing member 23. The top cover 21 covers the upper portion of the compressor unit 14 such that an outer peripheral edge of the top cover 21 coincides with an outer peripheral edge of the side cover 22.

<Top Cover 21>

The top cover 21 closes an upper side of the sound absorbing member 23. The top cover 21 is made of a rubber material for sound insulation and waterproofness. The top cover 21 has a flat plate shape, and has hole portions each of which allows the pipe 11 connected to the compressor 105 to be pulled to the outside of the top cover 21.

<Side Cover 22>

The side cover 22 is in contact with the outer peripheral portion of the sound absorbing member 23. The side cover 22 is made of a rubber material for sound insulation and waterproofness. The side cover 22 surrounds a side of the compressor unit 14 in such a manner to surround an outer peripheral portion of a barrel portion of the compressor unit 14 surrounded by the sound absorbing member 23. The side cover 22 has a side that is open to face part of the compressor unit 14 that can be insulated by the separator 10 against sound.

<Sound Absorbing Member 23>

Figure 7:
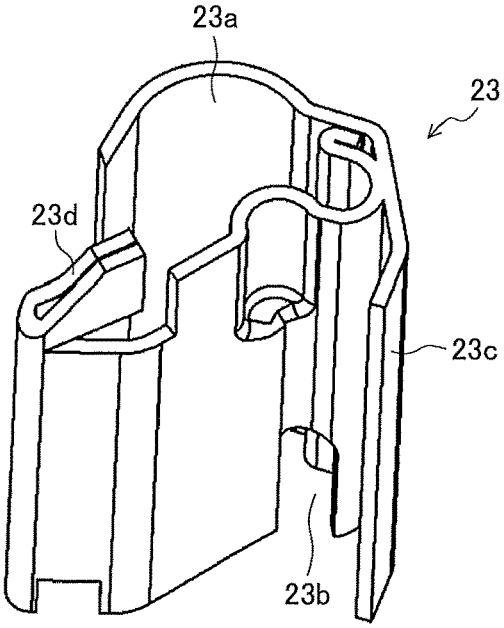
FIG. 7 is a perspective view illustrating a sound absorbing member according to the embodiment 1 of the present disclosure.

FIG. 7 is a perspective view illustrating the sound absorbing member 23 according to the embodiment 1 of the present disclosure. As illustrated in FIG. 7, the sound absorbing member 23 is located inward of the top cover 21 and apart from the base 3 on which the compressor unit 14 is mounted. Also, the sound absorbing member 23 covers together with the side cover 22, the compressor unit 14. The sound absorbing member 23 entirely covers a region located inward of the side cover 22. The sound absorbing member 23 is made of a felt material for sound absorption. The upper side of the sound absorbing member 23 is covered by the top cover 21, whereby water from the pipes 11 is prevented from dropping on the sound absorbing member 23, that is, the dropping water is reliably received by the top cover 21. The sound absorbing member 23 is located apart from the base 3, and the upper side of the sound absorbing member 23 is covered by the top cover 21. Therefore, even when a felt material having a high sound absorption performance is used for the sound absorbing member 23, the sound absorbing member 23 does not absorb water. Thus, needless to say, there is no possibility that the sound absorbing member 23 that has absorbed water will contact and corrode the compressor 105 and other components.

The sound absorbing member 23 includes a cylindrical portion 23*a*, a slit 23*b*, and a covering portion 23*c*. The cylindrical portion 23*a* surrounds the substantially entire compressor unit 14. The slit 23*b* allows the pipe 11 to be pulled from the cylindrical portion 23*a*. The covering portion 23*c* protrudes from the cylindrical portion 23*a* to cover a region located outward of the slit 23*b*.

<Cylindrical Portion 23*a*>

The cylindrical portion 23*a* surrounds the entire outer periphery of a side surface portion of the compressor unit 14 that includes the compressor 105, the upward/downward extending portions 17*a* and 17*b* of the pipes 11, and the suction muffler 12. That is, the cylindrical portion 23*a* substantially entirely covers the compressor unit 14 that includes various components, with spaces provided between these various components. The cylindrical portion 23*a* is formed into a cylindrical shape by joining one end portion of the sound absorbing member 23 to the body portion of the sound absorbing member 23. Any method, for example, sewing or fixation using string, may be adopted as a method of joining the one end portion of the sound absorbing member 23 to the body portion. A hook portion 23*d* is provided at an upper portion of the cylindrical portion 23*a* such that the hook portion 23*d* is formed in the shape of a loop and to have a closed end.

<Slit 23*b*>

The sound absorbing member 23 has the slit 23*b* that allows the pipe 11 located adjacent to the compressor 105 to be pulled from a lower portion of the upward/downward extending portion 17*a* of the pipe 11 to the outside of the compressor unit 14 covered by the sound absorbing member 23. The slit 23*b* is formed as an opening formed in a lower end of the sound absorbing member 23.

<Covering Portion 23*c*>

The sound absorbing member 23 includes the covering portion 23*c* that covers the region located outward of the slit 23*b*. The covering portion 23*c* is formed into a single plate shape at another end portion of the sound absorbing member 23 that extends from the cylindrical portion 23*a*, which is formed into a cylindrical shape by combining one end portion and the body portion of the sound absorbing member 23. The covering portion 23*c* has such a size as to allow the covering portion 23*c* to cover the slit 23*b*.

<Attachment of Soundproof Structure 20>

After the pipes 11 and other components are welded to the compressor unit 14, and the compressor unit 14 is mounted on the base 3, the soundproof structure 20 is provided to cover the compressor unit 14. In this case, first, the sound absorbing member 23 surrounds the compressor unit 14, and then, the side cover 22 and the top cover 21 cover the compressor unit 14 surrounded by the sound absorbing member 23.

<Attachment of Sound Absorbing Member 23>

Figure 8:
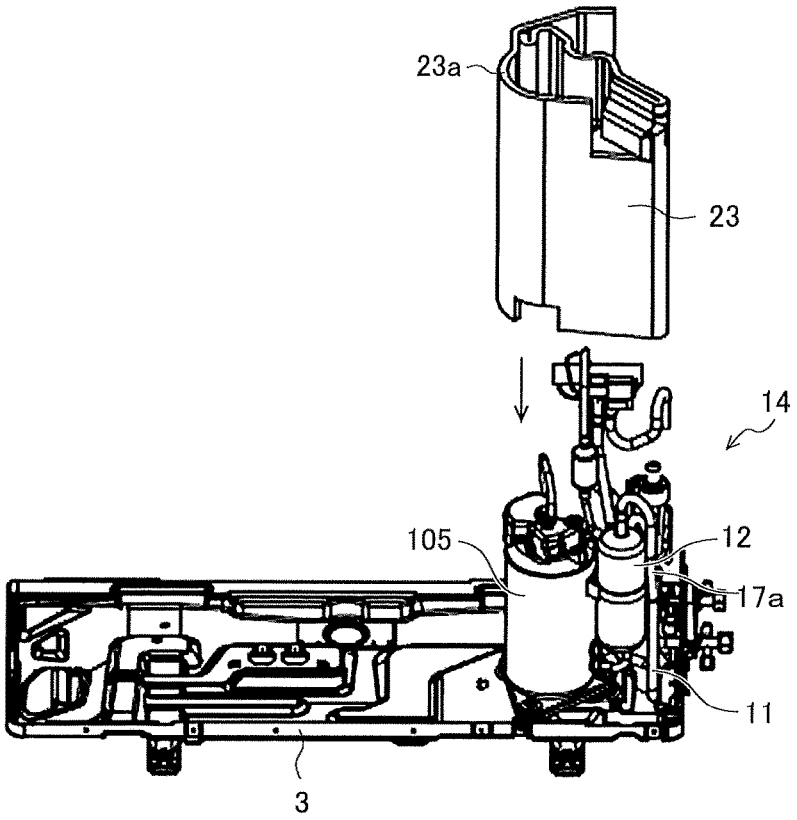
FIG. 8 is a perspective view illustrating attachment of the sound absorbing member according to the embodiment 1 of the present disclosure to the compressor unit.

FIG. 8 is a perspective view illustrating attachment of the sound absorbing member 23 according to the embodiment 1 of the present disclosure to the compressor unit 14. As illustrated in FIG. 8, the compressor 105, the pipes 11, the suction muffler 12, and other components are provided in the machine chamber 9 of the outdoor unit 101. Therefore, in the machine chamber 9, the space for the sound absorbing member 23 is small. Thus, the sound absorbing member 23 is provided from above to cover the compressor unit 14 after the pipes 11, the suction muffler 12, and other components are connected to the compressor 105, such that the entire outer periphery of the side surface portion of the compressor unit 14 is surrounded by the cylindrical portion 23*a*. As a result, the substantially entire barrel portion of the compressor unit 14 is covered, and in addition the working efficiency of attachment of the sound absorbing member 23 is improved. Thereafter, the pipe 11 is drawn out from the slit 23*b* formed in the lower portion of the sound absorbing member 23, and the covering portion 23*c* covers the region located outward of the slit 23*b*.

<Attachment of Top Cover 21 and Side Cover 22>

Figure 9:
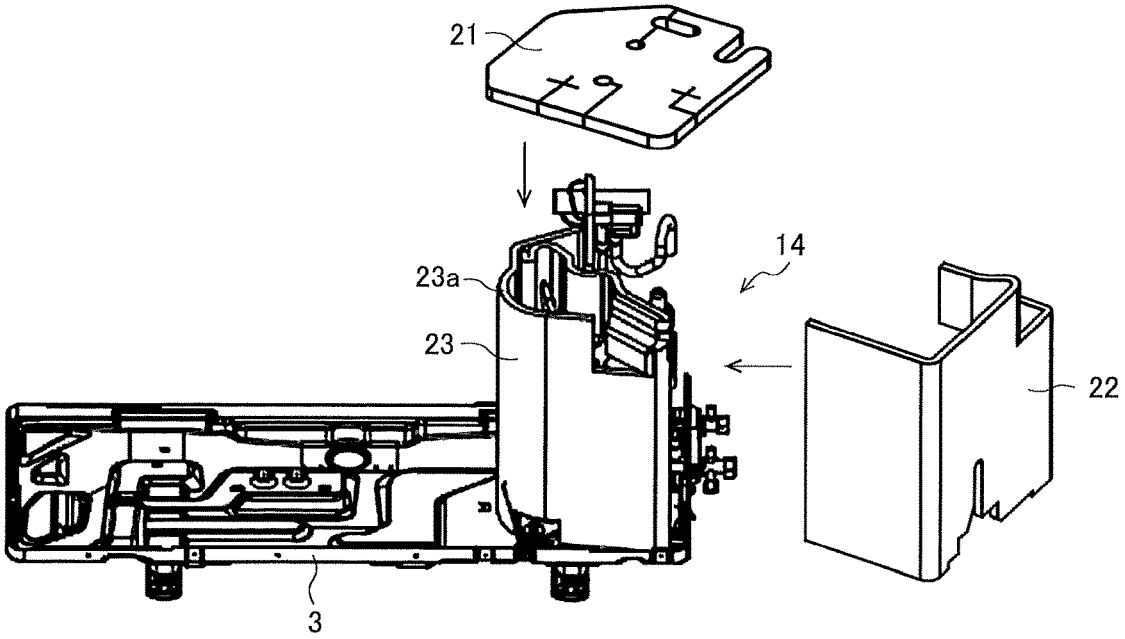
FIG. 9 is a perspective view illustrating attachment of a top cover and a side cover according to the embodiment 1 of the present disclosure to the compressor unit.

FIG. 9 is a perspective view illustrating attachment of the top cover 21 and the side cover 22 according to the embodiment 1 of the present disclosure to the compressor unit 14. As illustrated in FIG. 9, the side cover 22 covers the compressor unit 14 surrounded by the sound absorbing member 23, from an outer peripheral side of the compressor unit 14. Thereafter, the top cover 21 covers the compressor unit 14 covered by the side cover 22, from above.

<Covering State of Sound Absorbing Member 23 for Compressor Unit 14>

Figure 10:
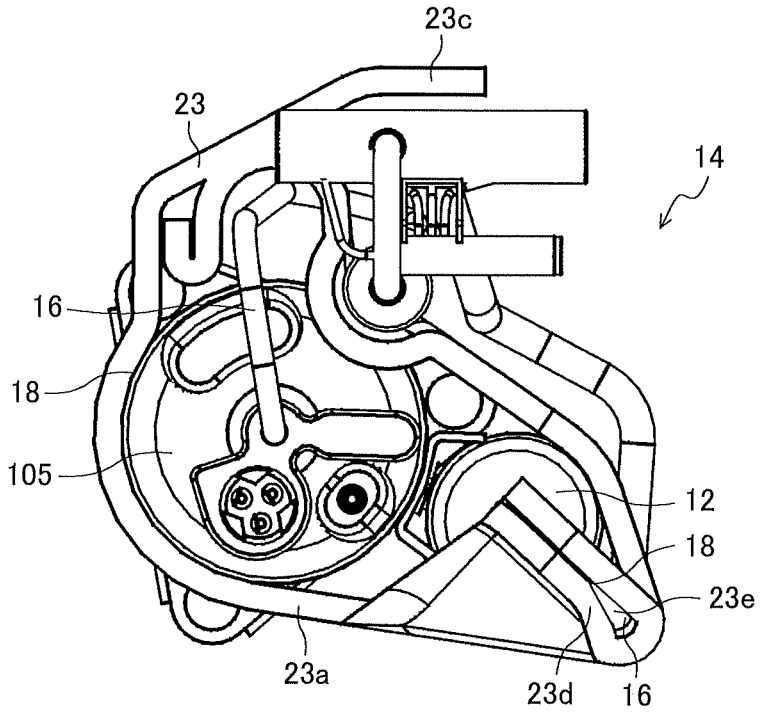
FIG. 10 is a top plan view illustrating the compressor unit according to the embodiment 1 of the present disclosure, with the sound absorbing member located to surround the compressor unit.
Figure 11:
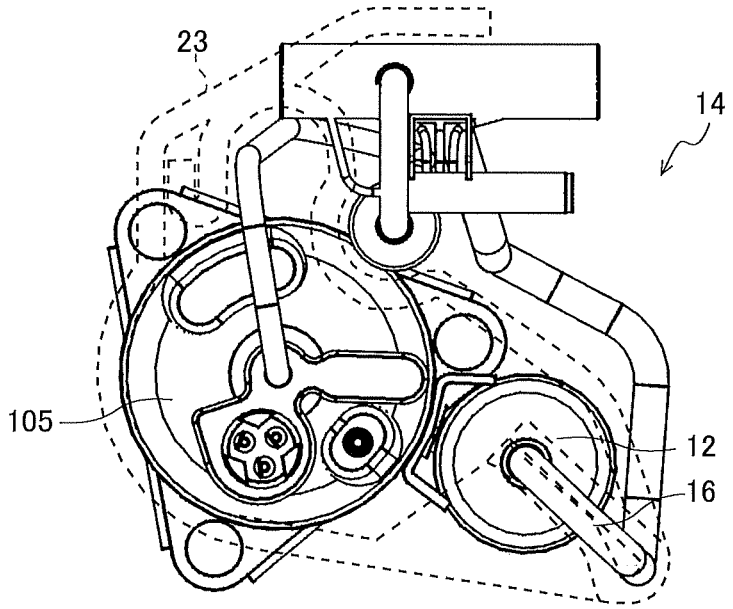
FIG. 11 is a top plan view illustrating an internal state of the compressor unit surrounded by the sound absorbing member according to the embodiment 1 of the present disclosure as viewed in the same direction as FIG. 10.
Figure 12:
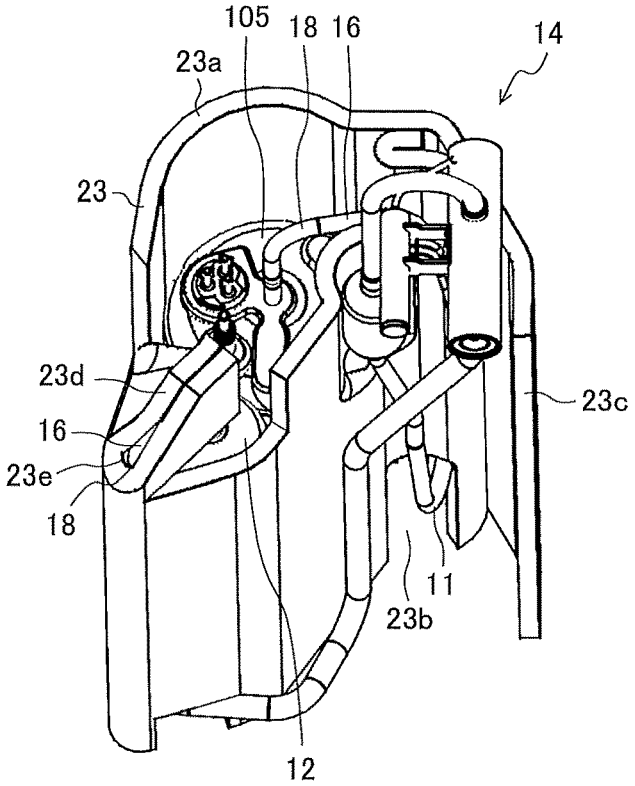
FIG. 12 is a perspective view illustrating the compressor unit according to the embodiment 1 of the present disclosure, with the sound absorbing member located to surround the compressor unit.
Figure 13:
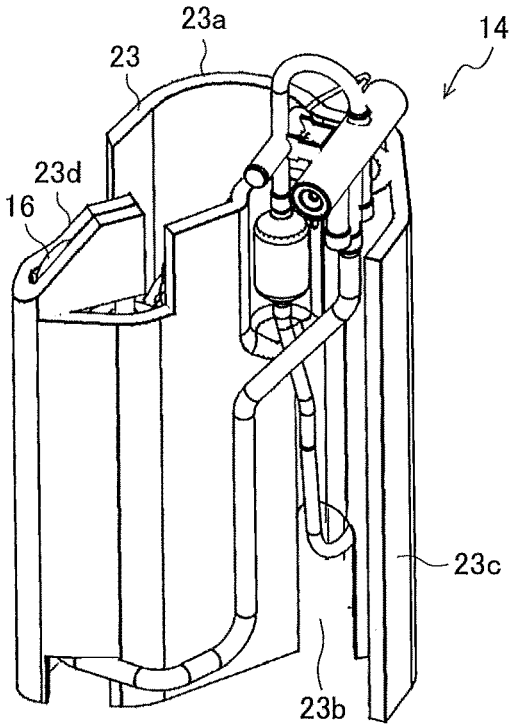
FIG. 13 is a perspective view illustrating the compressor unit according to the embodiment 1 of the present disclosure, with the sound absorbing member located to surround the compressor unit, as viewed in a different direction from FIG. 12.
Figure 14:
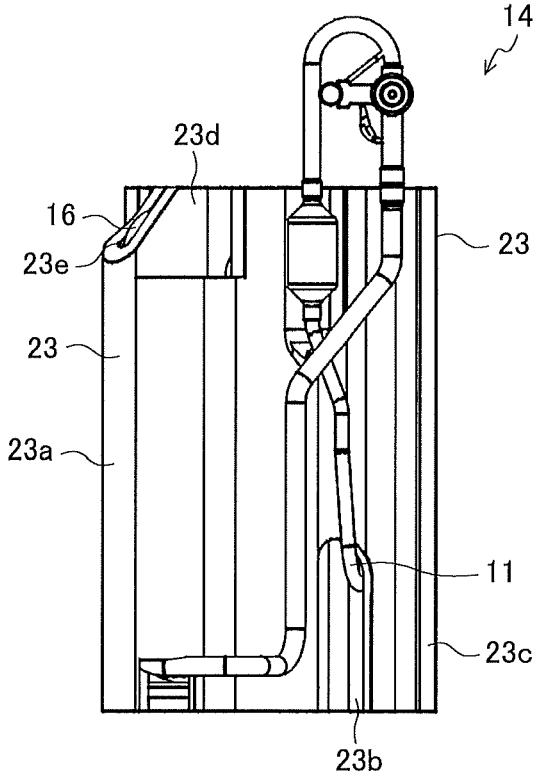
FIG. 14 is a side view illustrating the compressor unit according to the embodiment 1 of the present disclosure, with the sound absorbing member located to surround the compressor unit.
Figure 15:
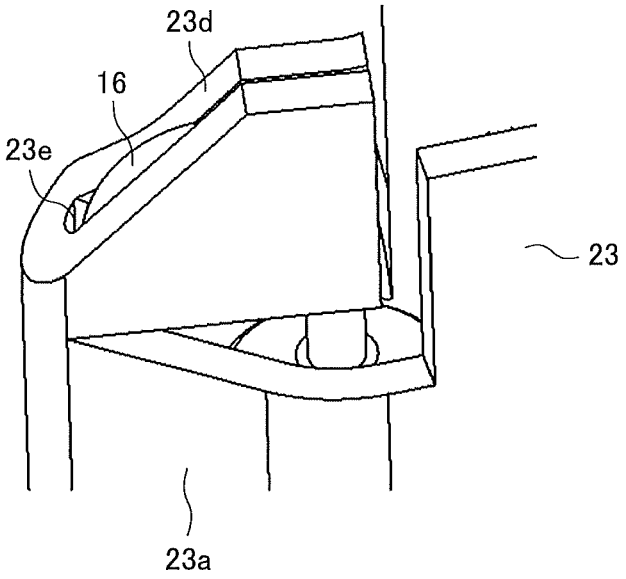
FIG. 15 is a perspective view illustrating a hook portion of the sound absorbing member according to the embodiment 1 of the present disclosure in an enlarged manner.
Figure 16:
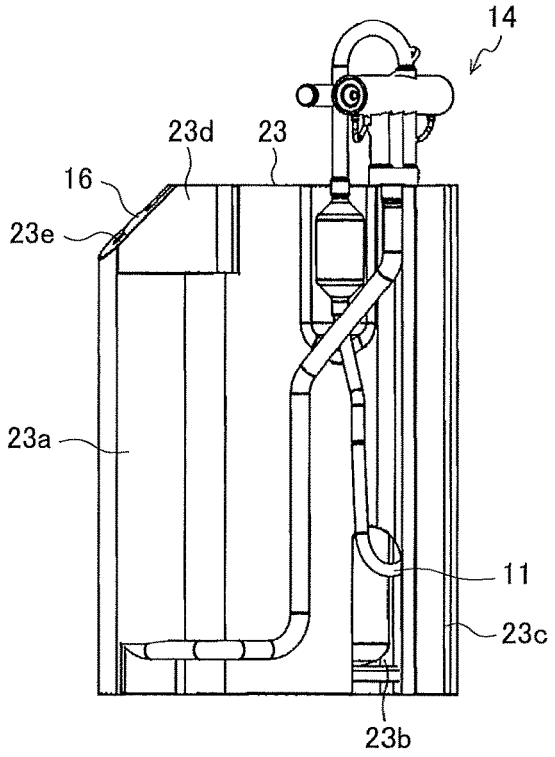
FIG. 16 is a side view illustrating the compressor unit according to the embodiment 1 of the present disclosure, with the sound absorbing member located to surround the compressor unit, as viewed in a different direction from FIG. 14.
Figure 17:
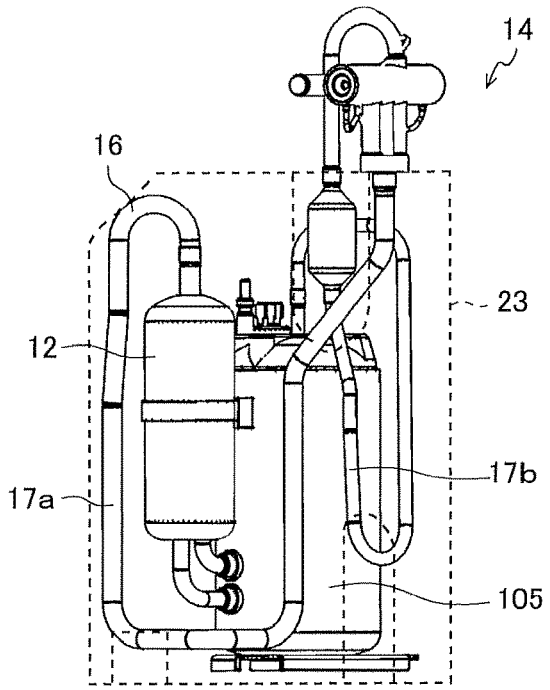
FIG. 17 is a side view illustrating the internal state of the compressor unit surrounded by the sound absorbing member according to the embodiment 1 of the present disclosure as viewed in the same direction as FIG. 16.

FIG. 10 is a top view illustrating the compressor unit 14 according to the embodiment 1 of the present disclosure, with the sound absorbing member 23 located to surround the compressor unit 14. FIG. 11 is a top view illustrating an internal state of the compressor unit 14 surrounded by the sound absorbing member 23 according to the embodiment 1 of the present disclosure, as viewed in the same direction as FIG. 10. FIG. 12 is a perspective view illustrating the compressor unit 14 according to the embodiment 1 of the present disclosure, with the sound absorbing member 23 located to surround the compressor unit 14. FIG. 13 is a perspective view illustrating the compressor unit 14 according to the embodiment 1 of the present disclosure, with the sound absorbing member 23 located to surround the compressor unit 14, as viewed in a different direction from that in FIG. 12. FIG. 14 is a side view illustrating the compressor unit 14 according to the embodiment 1 of the present disclosure, with the sound absorbing member 23 located to surround the compressor unit 14. FIG. 15 is an enlarged perspective view illustrating the hook portion 23*d* of the sound absorbing member 23 according to the embodiment 1 of the present disclosure. FIG. 16 is a side view illustrating the compressor unit 14 according to the embodiment 1 of the present disclosure, with the sound absorbing member 23 located to surround the compressor unit 14, as viewed in a different direction from that in FIG. 14. FIG. 17 is a side view illustrating the internal state of the compressor unit 14 surrounded by the sound absorbing member 23 according to the embodiment 1 of the present disclosure, as viewed in the same direction as FIG. 16.

As illustrated in FIGS. 10 to 17, the sound absorbing member 23 includes two support portions 18 that are supported at respective positions at the compressor unit 14. The two support portions 18 holds the sound absorbing member 23, such that the sound absorbing member 23 is suspended and the lower end of the sound absorbing member 23 is floated apart from the base 3 on which the compressor 105 is mounted. The two support portions 18 are provided opposite to each other in the compressor unit 14. The number of support portions 18 may be set to two or more.

As illustrated in FIG. 15, one of the two support portions 18 is the hook portion 23*d* that is formed by folding the sound absorbing member 23 and joining upper edge portions of the sound absorbing member 23 to each other. The hook portion 23*d* is formed in the shape of a loop, and the diameter of the hook portion 23*d* decreases in a direction toward the distal end of the hook portion 23*d*. The hook portion 23*d* has an opening portion 23*e* at the distal end. As illustrated in FIGS. 11, 12, and 17, the hook portion 23*d* is hooked to the bent portion 16, which connects two upward/downward extending portions of the pipe 11 that are located at the upper portion of the compressor unit 14, and which is provided at a higher position than the upper surface of the compressor 105. In other words, the hook portion 23*d* is hooked to the bent portion 16 that is an inverted U-shaped portion of the pipe 11. As illustrated in FIG. 15, the bent portion 16 of the pipe 11 is exposed from the opening portion 23*e* of the hook portion 23*d* hooked to the bent portion 16. Because of such a configuration, an operator can visually recognize the presence of the pipe 11, and the opening portion 23*e* is fitted onto the bent portion 16, whereby the sound absorbing member 23 is positioned. In other words, the upper portion of the sound absorbing member 23 is positioned when the hook portion 23*d* is hooked to the bent portion 16, and the sound absorbing member 23 is held by the two support portions 18 such that the sound absorbing member 23 is suspended so as not to fall, while surrounding the entire periphery of the side surface portion of the compressor unit 14.

As illustrated in FIGS. 10 to 17, the other of the two support portions 18 is stuck to the outer peripheral surface of the compressor 105 and located opposite to the hook portion 23*d* in the compressor unit 14. Because of such a configuration, the hook portion 23*d* hooked to the bent portion 16 and the support portion 18 stuck to the outer peripheral surface of the compressor 105 pull each other. Thus, the sound absorbing member 23 made of a felt material is suspended while surrounding the substantially entire compressor unit 14 without being displaced. Furthermore, the sound absorbing member 23 is brought into close contact with the compressor 105, and thus easily absorbs noise made by the compressor 105, which is a noise source.

As illustrated in FIGS. 10 and 11, the sound absorbing member 23 surrounds the entire compressor unit 14, which includes the compressor 105, the upward/downward extending portions 17*a* and 17*b*, and the suction muffler 12. After the compressor 105 and the pipes 11 are welded to each other, the sound absorbing member 23 is attached to the compressor unit 14 from above. As illustrated in FIGS. 12 to 14, 16, and 17, the slit 23*b* formed in the lower portion of the sound absorbing member 23 attached to the substantially entire compressor unit 14 allows the pipe 11 connected to the compressor 105 to be pulled to the outside of the sound absorbing member 23. As illustrated in FIGS. 10 to 17, the hook portion 23*d* of the sound absorbing member 23, which is formed in the shape of a loop and to have a closed end, is hooked to the bent portion 16 of the pipe 11 connected to the compressor 105, thus holding the sound absorbing member 23 to prevent the sound absorbing member 23 from falling downwards. As illustrated in FIGS. 12 to 14, 16, and 17, the covering portion 23*c* having a plate shape and extending from the sound absorbing member 23 is located outward of the slit 23*b* to prevent leakage of sound from the slit 23*b*.

As described above, the hook portion 23*d* is hooked to the bent portion 16 of the pipe 11 connected to the compressor 105, whereby the sound absorbing member 23 is held. Thus, the sound absorbing member 23 does not come into contact with the base 3. Therefore, it is possible to prevent water absorption of the sound absorbing member 23 for water on the base 3. Furthermore, the sound absorbing member 23 includes the cylindrical portion 23*a*, and is thus attached to the entire compressor unit 14 from above the compressor unit 14 after the compressor 105 and the pipes 11 are welded. Furthermore, since the sound absorbing member 23 has the slit 23*b*, it is possible to avoid provision of the pipe 11 at a location where the sound absorbing member 23 is provided, whereby the working efficiency of attachment of the sound absorbing member 23 is improved. In addition, the covering portion 23*c*, which is formed into a single plate shape, is provided outward of the slit 23*b*, whereby it is possible to absorb sound leaking from the slit 23*b*.

<Method for Manufacturing Sound Absorbing Member 23>

Figure 18:
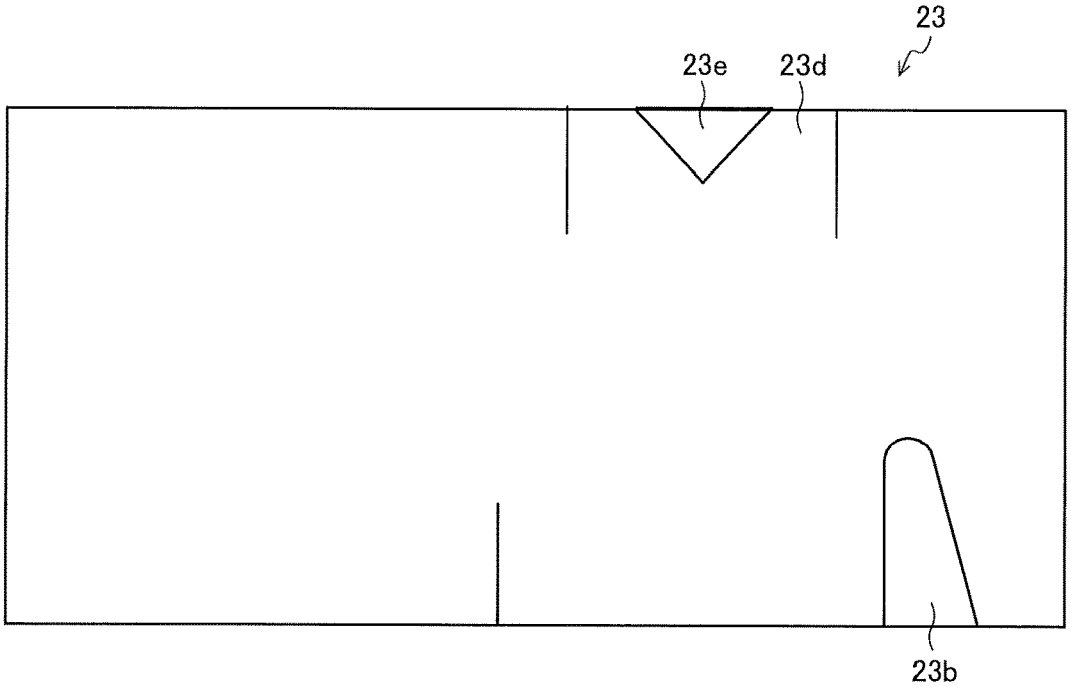
FIG. 18 is a developed view illustrating a single sheet to be processed to form the sound absorbing member according to the embodiment 1 of the present disclosure.
Figure 19:
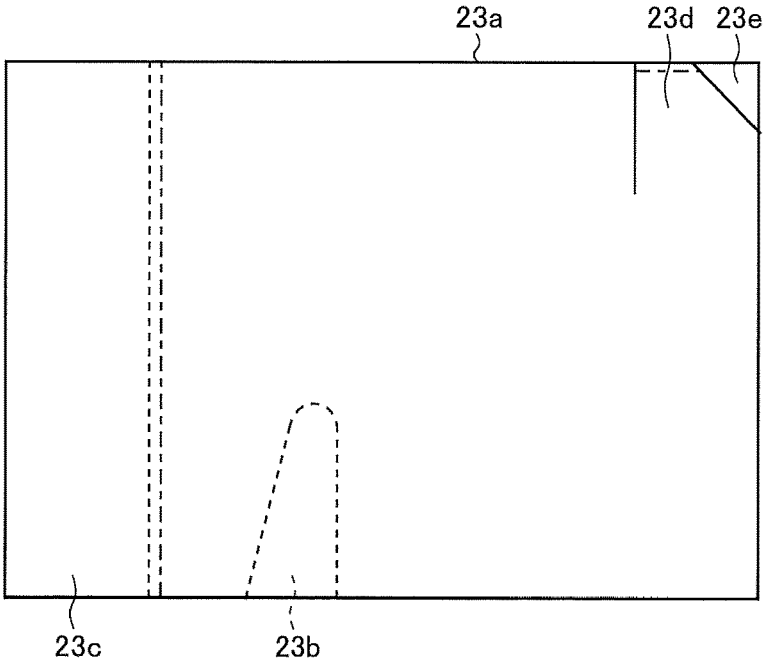
FIG. 19 is a side view illustrating a state where the single sheet, which is to be processed to form the sound absorbing member according to the embodiment 1 of the present disclosure, is folded to form a cylindrical portion and a covering portion.
Figure 20:
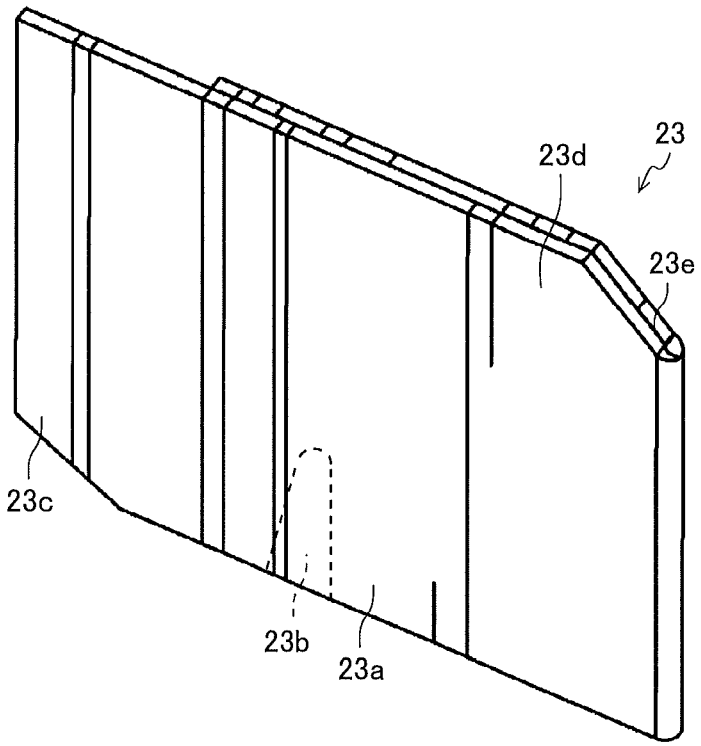
FIG. 20 is a perspective view illustrating a state where the single sheet, which is to be processed to form the sound absorbing member according to the embodiment 1 of the present disclosure, is folded to form the cylindrical portion and the covering portion, with the cylindrical portion not expanded.

FIG. 18 is a developed view illustrating a single sheet to be processed to form the sound absorbing member 23 according to the embodiment 1 of the present disclosure. FIG. 19 is a side view illustrating a state where the single sheet, which is to be processed to form the sound absorbing member 23 according to the embodiment 1 of the present disclosure, is folded to form the cylindrical portion 23*a* and the covering portion 23*c*. FIG. 20 is a perspective view illustrating a state where the single sheet, which is to be processed to form the sound absorbing member 23 according to the embodiment 1 of the present disclosure, is folded to form the cylindrical portion 23*a* and the covering portion 23*c*, with the cylindrical portion 23*a* not expanded.

As illustrated in FIG. 18, the sound absorbing member 23 is formed by processing the single sheet. Therefore, unnecessary processing or unnecessary components are not performed or provided, and the manufacturing efficiency is thus high. The sheet that is to be processed to form the sound absorbing member 23 is set to be in a flat state, and the opening portion 23*e* of the hook portion 23*d*, notches on both sides of the hook portion 23*d*, and the slit 23*b* are punched.

As illustrated in FIG. 19, one end side of the sheet to be processed to form the sound absorbing member 23 is folded and joined to the body portion of the sheet to form the cylindrical portion 23*a*, with the other end portion side of the sheet projected. Furthermore, the upper end portions of the hook portion 23*d* are joined together. In the case where the sound absorbing member 23 is made of a felt material, it suffices to sew the jointed upper end portions of the hook portion 23*d* to each other.

In the sound absorbing member 23 that has been formed to have the cylindrical portion 23*a* and the hook portion 23*d* as illustrated in FIG. 20, necessary processing is finished. Therefore, when the sound absorbing member 23 is made upright, it is more clearly found that the sound absorbing member 23 is doubled up. When the cylindrical portion 23*a* is curved in such a manner as to define a space as illustrated in FIG. 7, the sound absorbing member 23 has such a shape as to allow the sound absorbing member 23 to cover the compressor unit 14.

Advantages of Embodiment 1

According to the embodiment 1, the compressor unit 14 includes the compressor 105 and the pipes 11 that are connected to respective sides of the compressor 105, that is, the suction side and the discharge side of the compressor 105. The compressor unit 14 includes the sound absorbing member 23 that surrounds the outer periphery of the side surface portion of the compressor unit 14. The sound absorbing member 23 includes the plurality of support portions 18 that are supported at least at two positions of the compressor unit 14. At least one of the plurality of support portions 18 is the hook portion 23*d* that is formed by folding the sound absorbing member 23 and joining the upper edge portions of the sound absorbing member 23 to each other. Each of the pipes 11 includes the bent portion 16 that connects two portions of the pipe 11 that are located in an upper region in the compressor unit 14 and extend in the up/down direction. The upper portion of the sound absorbing member 23 is positioned when the hook portion 23*d* is hooked to the bent portion 16, and the sound absorbing member 23 is held by the plurality of support portions 18 such that the sound absorbing member 23 is suspended and thus located apart from the base 3 on which the compressor 105 is mounted.

In the above configuration, for example, the compressor 105 and the pipes 11 are welded to each other, and the sound absorbing member 23 is then attached to the entire outer periphery of the side surface portion of the compressor unit 14. Therefore, the sound absorbing member 23 can surround the substantially entire outer periphery of the side surface portion of the compressor unit 14 including the compressor 105 and the pipes 11, whereby the compressor unit 14 can be efficiently assembled and the working efficiency can be improved. Furthermore, the sound absorbing member 23 does not need to be designed to have such a specific shape as to prevent the sound absorbing member 23 from touching a flame given at the time of welding the compressor 105 and the pipes 11 to each other; that is, the sound absorbing member 23 can be formed into a simple shape. In addition, it is not necessary to use a high flameproof material for the sound absorbing member 23; that is, the sound absorbing member 23 can be formed of a material having a good sound absorption performance. Furthermore, the hook portion 23*d* is hooked to the bent portion 16 of the pipe 11, and the sound absorbing member 23 is held by the two support portions 18 such that the sound absorbing member 23 is suspended and thus located apart from the base 3 on which the compressor 105. Because of such a configuration, the sound absorbing member 23 is prevented from absorbing water on the base 3 of the outdoor unit 101, on which the compressor 105 is mounted. Therefore, there is no possibility that the sound absorbing member 23 that has absorbed water will contact the compressor 105 and the compressor 105 will corrode. Furthermore, the sound absorbing member 23 is held by the two support portions 18 such that the sound absorbing member 23 is suspended, as a result of which the sound absorbing member 23 is stably held. In addition to the above, since the hook portion 23*d* is located at the upper portion of the sound absorbing member 23, the sound absorbing member 23 can be attached from a region located above the compressor unit 14. Moreover, the hook portion 23*d* is located at the upper portion of the sound absorbing member 23, and the suspended sound absorbing member 23 is thus prevented from falling.

According to the embodiment 1, the pipes 11 include the upward/downward extending portions 17*a* and 17*b* each of which extends in the up/down direction at a position adjacent to the compressor 105. The sound absorbing member 23 surrounds the entire outer periphery of the side surface portion of the compressor unit 14, which includes the compressor 105 and the upward/downward extending portions 17*a* and 17*b*.

Because of such a configuration, the sound absorbing member 23 can surround the entire outer periphery of the side surface portion of the compressor unit 14 including the compressor 105 and the upward/downward extending portions 17*a* and 17*b*, and the compressor unit 14 can be efficiently assembled, thus improving the working efficiency.

According to the embodiment 1, the sound absorbing member 23 has the slit 23*b* that allows the pipe 11 from the lower portion of the upward/downward extending portion 17*a* to be pulled to the outside of the compressor unit 14.

Because of the above configuration, the pipe 11 connected to the compressor 105 can be drawn out from the slit 23*b* to the outside of the sound absorbing member 23. Therefore, when the sound absorbing member 23 is set such that the sound absorbing member 23 surrounds the entire compressor unit 14 including the compressor 105 and the upward/downward extending portions 17*a* and 17*b*, the working efficiency is not reduced by the pipes 11 connected to the compressor 105. Therefore, the compressor unit 14 can be efficiently assembled and the working efficiency can be improved.

According to the embodiment 1, the sound absorbing member 23 includes the covering portion 23*c* that covers the region located outward of the slit 23*b*.

In the above configuration, the covering portion 23*c* covers the region located outward of the slit 23*b*, thereby preventing leakage of sound from the slit 23*b*.

According to the embodiment 1, the bent portion 16 is located at a higher position than the upper surface of the compressor 105.

In the above configuration, the hook portion 23*d* is hooked to the bent portion 16 of the pipe 11 located at a higher position than the compressor 105, and the sound absorbing member 23 is held by the two support portions 18 such that the sound absorbing member 23 is suspended. Furthermore, since the hook portion 23*d* is provided at the upper portion of the sound absorbing member 23, the sound absorbing member 23 is attached to the compressor unit 14 from above, and the hook portion 23*d* is hooked to the bent portion 16 at last. In addition, since the hook portion 23*d* is located at the upper portion of the sound absorbing member 23, the upper portion of the sound absorbing member 23 is positioned by hooking the hook portion 23*d* to the bent portion 16, and the suspended sound absorbing member 23 is prevented from falling.

According to the embodiment 1, the hook portion 23*d* has the opening portion 23*e*.

In the above configuration, the pipe 11 that is provided such that the hook portion 23*d* is hooked to the pipe 11 can be viewed from the opening portion 23*e*, whereby an operator can visually recognize the presence of the pipe 11. Furthermore, the bent portion 16 of the pipe 11 is fitted in the opening portion 23*e*, whereby the sound absorbing member 23 can be positioned.

According to the embodiment 1, the two support portions 18 are provided opposite to each other in the compressor unit 14.

In the above configuration, the compressor unit 14 includes the compressor 105 and the pipes 11, and the compressor unit 14 itself has a large area as a whole, which includes spaces. However, the two support portions 18 are provided opposite to each other in the compressor unit 14. Therefore, even when the compressor unit 14 has the spaces, the two support portions 18 can support the sound absorbing member 23 such that the sound absorbing member 23 surrounds the substantially entire compressor unit 14.

According to the embodiment 1, at least one of the two support portions 18 is stuck to the outer peripheral surface of the compressor 105.

In the above configuration, at least one of the two support portions 18 is stuck to the outer peripheral surface of the compressor 105, and the sound absorbing member 23 is held by the two support portions 18 such that the sound absorbing member 23 is suspended.

According to the embodiment 1, the compressor unit 14 includes the suction muffler 12. The sound absorbing member 23 surrounds the outer periphery of the side surface portion of the compressor unit 14 including the suction muffler 12.

In the above configuration, the sound absorbing member 23 can surround the outer periphery of the side surface portion of the compressor unit 14 including the suction muffler 12, and the compressor unit 14 can be efficiently assembled, whereby the working efficiency can be improved.

According to the embodiment 1, the sound absorbing member 23 includes the cylindrical portion 23*a*, the slit 23*b*, and the covering portion 23*c*. The cylindrical portion 23*a* surrounds the outer periphery of the side surface portion of the compressor unit 14. The slit 23*b* allows the pipe 11 to be pulled from the cylindrical portion 23*a*. The covering portion 23*c* protrudes from the cylindrical portion 23*a* to cover the region located outward of the portion having the slit 23*b*.

In the above configuration, the cylindrical portion 23*a* can surround the entire compressor unit 14. Furthermore, the pipe 11 connected to the compressor 105 can be drawn out from the slit 23*b* to the outside of the cylindrical portion 23*a*. In addition, the covering portion 23*c* covers the region located outward of the slit 23*b*, whereby leakage of sound from the slit 23*b* can be prevented.

According to the embodiment 1, the cylindrical portion 23*a* is formed into a cylindrical shape by joining the one end portion of the sound absorbing member 23 to the body portion of the sound absorbing member 23. The covering portion 23*c* is formed on the other end portion of the sound absorbing member 23, which extends from the cylindrical portion 23*a*, in such a manner as to have a single plate shape.

In the above configuration, the cylindrical portion 23*a* can surround the substantially entire compressor unit 14. Furthermore, the covering portion 23*c* is formed on the other end portion of the sound absorbing member 23 and in the shape of a single plate shape, the other end portion of the sound absorbing member 23 extending from the cylindrical portion 23*a*. Therefore, the shape of the sound absorbing member 23 can be simplified, and the sound absorbing member 23 can thus be easily formed, thereby reducing the manufacturing cost.

According to the embodiment 1, the top cover 21 that closes the upper side of the sound absorbing member 23 is provided.

In the above configuration, the top cover 21 can prevent leakage of sound that is emitted toward a region located above the sound absorbing member 23. Furthermore, the top cover 21 can prevent water that drops from an upper region from entering the compressor unit 14.

According to the embodiment 1, the side cover 22 is provided that is set in contact with the outer peripheral portion of the sound absorbing member 23.

In the above configuration, the side cover 22 further improves the sound absorption performance.

According to the embodiment 1, the sound absorbing member 23 is provided to surround the outer periphery of the side surface portion of the compressor unit 14 after the pipes 11 are connected to the compressor 105.

In the above configuration, after the compressor 105 and the pipes 11 are connected to each other by welding or other methods, the sound absorbing member 23 is attached to the entire compressor unit 14. Therefore, the compressor unit 14 can be efficiently assembled and the working efficiency can thus be improved.

According to the embodiment 1, the sound absorbing member 23 is formed by processing a single sheet.

In the above configuration, the shape of the sound absorbing member 23 can be simplified, and the sound absorbing member 23 can thus be easily formed, thereby reducing the manufacturing cost.

According to the embodiment 1, the outdoor unit 101 of the air-conditioning apparatus 100 includes the above compressor unit 14.

In the above configuration, in the outdoor unit 101 of the air-conditioning apparatus 100, which includes the compressor unit 14, for example, the compressor 105 and the pipes 11 are welded to each other, and the sound absorbing member 23 is then attached to the entire compressor unit 14. Therefore, the sound absorbing member 23 can surround the outer periphery of the side surface portion of the compressor unit 14 including the compressor 105 and the pipes 11, and the compressor unit 14 can be efficiently assembled, whereby the working efficiency can be improved.

According to the embodiment 1, the air-conditioning apparatus 100 includes the above outdoor unit 101.

In the above configuration, in the air-conditioning apparatus 100 that includes the outdoor unit 101, for example, the compressor 105 and the pipes 11 are welded to each other, and the sound absorbing member 23 is then attached to the entire compressor unit 14. Therefore, the sound absorbing member 23 can surround the outer periphery of the side surface portion of the compressor unit 14 including the compressor 105 and the pipes 11, and the compressor unit 14 can be efficiently assembled, whereby the working efficiency can be improved.

REFERENCE SIGNS LIST

1 housing 2 top panel 3 base 4 front panel 4*a* opening portion 5 fan guard 6 left side panel 7 right side panel 8 air-sending device chamber 9 machine chamber 10 separator 11, 11*a*, 11*b*, 11*c* pipe suction muffler 13 electric component box 14 compressor unit 15 fan 16 bent portion 17*a*, 17*b* upward/downward extending portion support portion 20 soundproof structure 21 top cover 22 side cover 23 sound absorbing member 23*a* cylindrical portion 23*b* slit 23*c* covering portion 23*d* hook portion 23*e* opening portion 100 air-conditioning apparatus 101 outdoor unit 102 indoor unit 103 gas refrigerant pipe 104 liquid refrigerant pipe 105 compressor 106 four-way valve 107 outdoor heat exchanger 108 expansion valve 109 indoor heat exchanger

The invention claimed is:

1. A compressor unit comprising:

a compressor;

pipes connected to a suction side and a discharge side of the compressor; and a sound absorbing member configured to surround an outer periphery of a side surface portion of the compressor unit, wherein the sound absorbing member includes a plurality of support portions that are supported at at least two positions of the compressor unit, at least one of the plurality of support portions is a hook portion that is formed by folding the sound absorbing member and joining upper edge portions of the sound absorbing member to each other, the pipes include a bent portion that connects two portions extending in an up/down direction and that is located in an upper region in the compressor unit, and an upper portion of the sound absorbing member is positioned by hooking the hook portion to the bent portion, and the sound absorbing member is held by the plurality of support portions such that the sound absorbing member is suspended and thus located apart from a base on which the compressor is mounted.

2. The compressor unit of claim 1, wherein the pipes include an upward/downward extending portion that extends in the up/down direction at a position adjacent to the compressor, and the sound absorbing member surrounds an entire outer periphery of a side surface portion of the compressor unit including the compressor and the upward/downward extending portion.

3. The compressor unit of claim 2, wherein the sound absorbing member has a slit that allows a lower portion of the upward/downward extending portion to be pulled to the outside of the compressor unit.

4. The compressor unit of claim 3, wherein the sound absorbing member includes a covering portion that covers a region located outward of the slit.

5. The compressor unit of any claim 1, wherein the bent portion is located at a higher position than an upper surface of the compressor.

6. The compressor unit of claim 1, wherein the hook portion has an opening portion.

7. The compressor unit of claim 1, wherein one of the plurality of support portions and at least an other of the plurality of support portions are provided opposite to each other in the compressor unit.

8. The compressor unit of claim 1, wherein at least one of the plurality of support portions is stuck to an outer peripheral surface of the compressor.

9. The compressor unit of claim 1, further comprising a suction muffler, wherein the sound absorbing member surrounds the outer periphery of the side surface portion of the compressor unit that includes the suction muffler.

10. The compressor unit of claim 1, wherein the sound absorbing member includes a cylindrical portion, a slit, and a covering portion, the cylindrical portion surrounding the outer periphery of the side surface portion of the compressor unit, the slit allowing the pipe to be pulled from the cylindrical portion, the covering portion protruding from the cylindrical portion to cover a region located outward of the slit.

11. The compressor unit of claim 10, wherein the cylindrical portion is formed into a cylindrical shape by joining one end portion of the sound absorbing member to a body portion of the sound absorbing member, and the covering portion is formed into a single plate shape at an other end portion of the sound absorbing member, the other end portion of the sound absorbing member extending from the cylindrical portion.

12. The compressor unit of claim 1, comprising a top cover configured to close an upper side of the sound absorbing member.

13. The compressor unit of claim 1, comprising a side cover configured to be set on an outer peripheral portion of the sound absorbing member.

14. The compressor unit of claim 1, wherein the sound absorbing member surrounds the outer periphery of the side surface portion of the compressor unit after the pipes are connected to the compressor.

15. The compressor unit of claim 1, wherein the sound absorbing member is formed by processing a single sheet.

16. An outdoor unit for an air-conditioning apparatus, comprising the compressor unit of claim 1.

17. An air-conditioning apparatus comprising the outdoor unit of claim 16.

* * * * *